US006276174B1

(12) United States Patent
Wunner et al.

(10) Patent No.: US 6,276,174 B1
(45) Date of Patent: Aug. 21, 2001

(54) METHOD AND WARP KNITTING MACHINE FOR THE PRODUCTION OF KNITTED FABRIC HAVING A FREELY SELECTABLE PATTERN REPEAT

(75) Inventors: Roland Wunner, Schwarzenbach; Stefan Maier, Selbitz, both of (DE)

(73) Assignee: LIBA Maschinenfabrik GmbH (DE)

( * ) Notice: Subject to any disclaimer, the term of this patent is extended or adjusted under 35 U.S.C. 154(b) by 0 days.

(21) Appl. No.: 09/291,286

(22) Filed: Apr. 14, 1999

(30) Foreign Application Priority Data

Apr. 14, 1998 (DE) ..... 198 16 440

(51) Int. Cl.[7] ..... D04B 23/12
(52) U.S. Cl. ..... 66/84 A; 66/125 R
(58) Field of Search ..... 66/203, 82 R, 66/83, 84 R, 84 A, 125 R

(56) References Cited

U.S. PATENT DOCUMENTS

| | | | | |
|---|---|---|---|---|
| 4,348,876 | * | 9/1982 | Roth | 66/84 A |
| 4,556,440 | * | 12/1985 | Krueger | 66/84 A |
| 4,703,631 | * | 11/1987 | Naumann et al. | 66/84 A |
| 4,807,450 | * | 2/1989 | Weiland | 66/84 A |
| 4,872,323 | * | 10/1989 | Wunner | 66/84 A |
| 5,072,602 | * | 12/1991 | Naumann | 66/84 A |
| 5,269,863 | * | 12/1993 | Middelman | 66/84 A |

FOREIGN PATENT DOCUMENTS

| | | |
|---|---|---|
| 256532 A1 | 5/1988 | (DD) . |
| 2114700 | 10/1972 | (DE) . |
| 3128024 C2 | 6/1984 | (DE) . |
| 39 32 184 C2 | 6/1996 | (DE) . |
| 196 04 422 A1 | 8/1997 | (DE) . |
| 30 40 393 C2 | 5/1998 | (DE) . |

* cited by examiner

*Primary Examiner*—Danny Worrell
(74) *Attorney, Agent, or Firm*—Banner & Witcoff, Ltd.

(57) ABSTRACT

A method for the production of a knitted material and a warp knitting machine for realizing the method is being described by which longitudinal conveyors are driven in such a manner so that the longitudinal conveyors are driven at least partially intermittently and/or continuously with at least at times varying speeds so that the weft threads are being guided into the area of the knitting needles according to a pattern and at arbitrary points in time and one after the other in arbitrarily desired numbers which will result in an indefinitely long and freely selectable weft thread pattern repeat. According to a further aspect of the invention an arrangement is being described in which the arrangement includes a warp knitting machine having a separate frame. On the frame, that is, independent from the warp knitting machine there is arranged a weft thread insertion system having a servo motor drive including an associated weft carriage and a weft carriage guide, weft thread off-set rakes having their own servo motor drive and longitudinal conveyors with their drive as well as a longitudinal conveyor frame. The drive for the longitudinal conveyors, however, is obtained independently from the machine drive but is computer controlled so that the longitudinal conveyors execute a movement, at least between individual weft threads, at least partially intermittently and/or continuously with at least at times varying speeds.

25 Claims, 10 Drawing Sheets

METHOD AND WARP KNITTING MACHINE FOR THE PRODUCTION OF KNITTED FABRIC HAVING A FREELY SELECTABLE PATTERN REPEAT

The invention is concerned with a method and a warp knitting machine for the production of a knitted fabric having a freely selectable weft thread pattern repeat.

BACKGROUND OF THE INVENTION

According to the state of the art, methods and warp knitting machines are known in which the weft thread pattern repeats can be influenced, however in relatively narrow margins. Principally, three ways for raising the pattern possibilities of the warp thread pattern repeats are known. In one, an influence of the warp thread pattern repeat is the result of a flexible arrangement of the weft thread carriage with off-set rakes, and in another, the influence is the result of a continuous movement of the transport chain of the warp knitting machine whereby the relationship between the fabric repeat and the weft thread repeat can be enlarged. Finally, it is known to influence the number of the knitted-in weft threads during a stitch forming phase by changing the movement sequence of the knitting elements.

DE 196 04 422 A1 describes a driving arrangement for working elements, especially, multiple thread guides on a weft carriage of a warp knitting machine. The weft carriage as well a the multiple thread guides thereon are each driven by a position regulated drive motor. This serves to realize the goal to reduce the mass to be moved and to shape their movements in a most variable way. Because of these position regulated drive motors, the rack movement of the multiple thread guides is correlated with the movement of the weft carriage whereby the type of laying-in of the weft thread sheets can be changed. The transport chains that lay-in the weft threads into the fontour of the warp knitting machine are driven continuously.

The disadvantage of this known arrangement consists in that by using multiple thread guides as working elements, the weft threads can only be deposited in groups and thereby can only be guided in groups into the knitting area of the warp knitting machine. When the number of the weft threads that are assembled in a group by way of the multiple thread guides and deposited by the same has to be changed, and it is necessary to change the number of the weft threads assembled in a group it is necessary to modify the machine which considerably decreases the flexibility of such a machine, with regard to the weft thread pattern repeat.

DE 39 32 184 C2 also describes a weft carriage having an off-set rake mounted thereon. The drive arrangement for the weft carriage is coupled with a computer by way of which a freely selectable movement principle for the weft carriage as well as for the off-set rake can be realized in dependency from the rotational angle position of the main drive shaft of the machine. The realized movement principle serves to match the differing thread materials. The longitudinal conveyors operate continuously and thereby convey the weft threads to the knitting area of the warp knitting machine after having been deposited into hooks.

DD 256 532 A1 further describes a control system for a weft laying carriage. Thread guiding blocks (multiple thread guides) are movably arranged on a changeable weft thread laying carriage. Thereby, any respective thread sheet is layed-in according to the control of the weft carriage and then, however, is continuously guided to the knitting area of the machine by way of the longitudinal conveyors.

Furthermore, from DE 30 40 393 C2, a weft thread magazine with return weft for a warp knitting machine is known. Thread guides have been arranged on a weft carriage and the weft carriage is moveable independently from the continuously unchanging movement of the longitudinal conveyors.

Because of the fact that the thread guide group is adjustable from an effective position wherein weft threads are deposited in groups into holders to an ineffective position where no transfer of weft threads into holders occurs, a group of weft threads can selectably be laid or not, whereby the longitudinal conveyors continue to move unimpaired. On one hand the weft threads can be laid with differing diagonal angles and on the other hand, the weft threads can be laid alternatively parallel or diagonal. Always, however, the weft threads are being deposited in groups and can only be guided in groups to the knitting area of the warp knitting machine. An enlargement of the pattern repeat is possible, however, the weft thread pattern multiplicity is greatly diminished.

DE 31 28 024 C2 describes a warp knitting machine having a warp thread magazine including longitudinal conveyors having a drive arrangement which induces a lower speed in the longitudinal conveyors that is lower than a normal speed. It also includes a pattern device by way of which the weft thread forwarders are effective only during part of the needle lifts. From DE PS 16 85 392 it is already known to reduce the conveying speed of the longitudinal conveyors which makes it possible to deliver a weft thread to only every second or third stitch row, for example, that is, it is thereby possible to create weft free stitch rows even though all holders of the longitudinal conveyors have weft threads therein. The longitudinal conveyors are driven by way of a drive shaft in a slow but always existing drive speed, whereby the speed is a result of an adjusting device having variously formed gearing therein. A disadvantage of the described warp knitting machine consists in that the rotational movement of the drive shaft for the longitudinal conveyors is derived from the main shaft of the warp knitting machine, that means, that the longitudinal conveyors are driven on a permanent basis. Thereby, the flexibility with regard to the obtainable weft thread pattern repeat is considerably diminished.

Further, DE-OS 21 14 700 describes a knitted fabric with through or full weft threads in which the weft threads are supposed to create some kind of a cross knob effect. Therefore, two or more weft threads at arbitrary intervals are bound-in by way of loops instead of stitches. The variation of the number of the weft threads is thereby obtained by changing the movement flow of the knitting elements. A disadvantage in the method of producing the fabric just described is that in obtaining the loops which are required for the binding-in of several weft threads for each stitch, is only possible by stopping the knitting needle in its upper position. This requires that the slide must be controlled in such a manner so that it can be disengaged which results in that the movement and the drive of the knitting elements is shaped in a complicated way and further results in a relative low number of machine rotations.

All of the three described types of influencing the weft thread pattern repeats have in common is that the weft thread pattern repeat, especially with regard to its flexibility in its construction is only variable in relative narrow limits.

OBJECTS OF THE INVENTION

A basic object of the invention consists in the creation of a method for the production of a knitted fabric and a warp knitting machine to realize the method by way of which the weft thread pattern repeat is freely selectable with extreme high flexibility and an arbitrary long length.

This object is achieved by way of the method having the characteristics of claim 1 and by way of the warp knitting machine having the characteristics of claim 10. Further developments are defined in dependent claims.

In the method for the production of a knitted fabric according to the invention having an indefinite long and freely selectable weft thread repeat, the weft threads are introduced into the area of the knitting elements by way of a weft insertion system and by way of longitudinal conveyors. According to the invention, the longitudinal conveyors are driven independently from the warp knitting machine on which the knitted fabris is being produced, at least partially intermittently and/or at least at times with varying speeds. Having the possibility of driving the longitudinal conveyors in a controlled manner intermittently and in an operating mode with a varying speed, the weft threads can be guided to the fontour of the knitting machine, that is, the knitting area, according to a pattern at arbitrary points in time and one after the other in arbitrarily desired numbers, the result is that an indefinite long and a freely selectable weft thread pattern repeat can be produced. Under intermittent should be understood, in this connection, any movement of the longitudinal conveyors in which its speed is at a point of zero. This intermittent movement can be evenly intermittent or arbitrarily intermittent, that means, the longitudinal conveyors can be stopped arbitrarily long during the feeding of an arbitrary number of weft threads. Intermittent should also include an at least short time movement return of the longitudinal conveyors because the speed of the movement return bisects the speed/time cycle of the time line. Under continuous with at least at times varying speed should be understood that the longitudinal conveyors are driven at least at times continuously and that the speed in the area of their permanent drive is however at least variable at times. The variation of the speed of the longitudinal conveyors is, among others, correlated with the movement of the knitting elements and the desired weft thread repeat.

An essential advantage of the inventive method consists in the fact that the highest possible flexibility is possible with regard to the desired weft thread pattern repeat. Thereby, indefinite long weft thread pattern repeats are possible because the weft threads can be delivered into the area of the knitting needles at arbitrary intervals and in arbitrarily desired numbers at arbitrary points in time, all according to the desired pattern.

According to a further and advantageous development of the inventive method, the longitudinal conveyors which are arranged on at least both sides of the width of the knitted fabric, are driven independently from each other whereby their respective drives are synchronized with each other. According to another advantageous further development, the weft threads are introduced essentially either in a parallel manner or diagonal. When the threads are introduced in a parallel manner, the longitudinal conveyors will lay-in a definite number of weft threads into the hooks, which are provided on the longitudinal conveyors to correspond to the high flexibility because the longitudinal conveyors are driven independently from the machine drive of the warp knitting machine. These laid-in weft threads are available, so to speak, as a weft thread reserve. Independently from the number of weft threads which are laid-into the hooks arranged on the longitudinal conveyors by a multiple thread guide in one group, for example, an arbitrary number of weft threads can be conveyed into the area of the knitting needles at arbitrary points in time and arbitrary intervals, all according to a desired weft thread pattern.

When the weft threads are introduced in a substantially diagonal manner, the group of weft threads, after having been introduced by a multiple thread guide, is preferably guided to the area of the knitting needles until the last diagonal thread has been knitted-in. There after the direction of the weft threads can be altered or be transferred again to a parallel weft thread insertion.

According to a further development of the inventive method, the weft insertion system and a weft thread off-set rake which is also located on the warp knitting machine, are driven independently from the machine drive of the warp knitting machine. Thereby, the flexibility to achieve a desired weft thread pattern can further be increased.

Preferably, according to the inventive method, at least in the insertion off-set phase by the weft insertion system and the weft thread off-set rake an intermittent movement is executed having movement components that are correlated with each other. The movement components that are correlated with each other are intermittent and/or continuous with at least at times a varying speed. Thereby it is ensured that also the weft insertion system and the weft thread off-set rake account for each other with the intermittent and/or continuous movement with at least at times varying speed of the longitudinal conveyors. Furthermore, it is ensured that the thereby freely selectable characteristic curve of the weft insertion system and the weft thread off-set rake increases the multiplicity of structuring the weft thread pattern.

Preferably, the longitudinal conveyors are driven in such a manner so that the hooks which are arranged on the longitudinal conveyors and the laid-in weft threads execute a forwarding motion when the next arranged weft thread has entered the vicinity of the knitting needles, which ensures hat the respective weft thread reaches behind the knitting needle. This forwarding-like movement of the longitudinal conveyors has the advantage so that the movement of the forwarding sinker is supported to the extent so that the correlation of the movement of the individual threads which participate in the stitch forming process is further optimized.

In order to assist in the cutting of the already bound-in weft threads, according to a further development of the inventive method and by way of example, the longitudinal conveyors execute a slight movement counter to their normal conveyor direction this ensures that the weft thread cutting device is able to cut the just bound-in weft thread but not yet cut weft thread in a reliable manner. At the same time it is possible to move the weft thread cutting device in the direction of the weft thread yet to be cut so that the weft thread can be cut during a minimal rest position.

Because of the fact that the longitudinal conveyors are driven independently from the machine drive of the warp knitting machine, the flexibility of their drives is a given to the extent that when the weft insertion system has been halted, the next weft thread to be delivered is not located in the vincinity of the forwarding sinker which undergoes a movement during each stitch forming cycle. Thereby, in a preferred manner, it is possible to shape the delivery of the weft threads in such a manner so that the knitting elements which are required during the stitch forming cycle, especially the forwarding sinker, are not impaired with regard to the delivered or to be delivered weft threads. Thereby an optimization of the stitch forming process is possible in that the movement of the individual threads that participate in the stitch forming process are better tuned to each other.

According to a second aspect of the invention, a warp knitting machine has been provided for the production of a knitted fabric including a machine drive, a weft thread insertion system including a weft carriage and longitudinal conveyors having their own drives and being located on at least both sides of the working width of the knitted fabric, whereby weft thread holders for the holding of weft threads are provided on the longitudinal conveyors which have been laid-into the weft thread holders by way of the weft thread insertion system and whereby the weft threads, by way of a movement of the longitudinal conveyors can be inserted into the area of the knitting needles. According to the invention, the drive for the longitudinal vonveyors is independent from the machine drive and is computer controlled, which thereby transfers a movement to the longitudinal conveyors at least between individual weft threads and at least at times intermittently and/or continuously with at least at times varying speeds. It is also possible , however, that the longitudinal conveyors are controlled by a computer in such a manner so that the weft threads in the area of the knitting elements execute an optimal movement with regard to the stitch forming process. With such an inventive warp knitting machine it is possible to produce a knitted fabric having an indefinite long and freely selectable weft thread pattern repeat. This results in an indefinite flexibility and pattern multiplicity.

Preferably, according to a further development of the inventive warp knitting machine, the drive of the longitudinal conveyors is realized by way of a drive shaft which is driven by a servo motor. To drive the longitudinal conveyors by way of drive shaft being driven by a servo motor has the advantage that the longitudinal conveyors can be driven synchroniously. However, it is also possible that each of the longitudinal conveyors has its own separate servo motor, whereby the servo motors are preferably synchronized.

Furthermore, it is preferably arranged that the drive for the weft carriage also includes a servo motor which also is being driven and controlled independently from the machine drive. According to a further development, weft thread off-set rakes are provided which also are driven by way of a servo motor which also is being driven and controlled independently from the machine drive. By arranging servo motors as the drives for the longitudinal conveyors, the weft carriage and weft thread off-set rakes, the flexibility with regard to the weft thread pattern is further enhanced.

Preferably, the weft thread off-set rakes and the weft carriage are driven in such a manner so that they, at least during part of their movement path, will execute a movement which is intermittent and/or continuous with at least a varying speed at times. This has the advantage that the movements of the weft thread off-set rakes and the weft carriage are optimally correlated with the movement of the longitudinal conveyors. Because of the fact that the weft thread off-set rakes, the weft carriage, as well as the longitudinal conveyors execute an intermittent and/or continuous movement with a speed at least varying at times, it is possible to correlate the movement of the weft threads and the weft thread off-set rakes with the movement of the longitudinal conveyors so that, even though during an intermittent movement or varying movement, the weft threads can reliably be laid into the holders which have been provided on the longitudinal conveyors. This represents the lay-in off-set phase.

Preferably, the movements of the weft carriage and the weft thread off-set rakes, which are derived from their respective servo motors, are tuned to each other so that the weft insertion, after an arbitrary weft, can be interrupted at any arbitrary length of time. Thereby it is possible to interrupt the weft insertion into the area of the knitting elements so that the longitudinal conveyors do not execute any movements, at least in intervals, so that the movement of the weft carriage and the weft thread off-set rake can be interrupted at any arbitrary point in time and after any arbitrary weft.

In order to ensure a knitting-in of the weft threads that have been conveyed to the area of the knitting needles and in order to obtain an optimal correlation of the movement of the individual threads that are to be knitted together, the longitudinal conveyors are driven, according to a further development example, so that the weft threads after having been conveyed into the area of the knitting needles undergo a forwarding-like movement and are thereby conveyed in a sure manner behind the knitting needles.

In another preferred embodiment it is also possible to move the longitudinal conveyors slightly counter to the delivery direction when an already bound-in but not yet cut weft thread has to be cut. Thereby, the movement of the longitudinal conveyors, in an advantageous manner, can be correlated with a reliable and optimal cutting of the weft threads by way of the weft thread cutting device.

Preferably, and furthermore, the longitudinal conveyors are driven in such a manner so that in the event of the weft thread insertion system having been stopped, the next to be delivered weft thread remains outside the area of the area of the movement of the forwarding sinker which is involved in every stitch forming cycle. Thereby, the movement of the forwarding sinker is not disturbed. Rather, because of a controlled movement of the longitudinal conveyors, the weft thread insertion is optimally tuned to the knitting elements. This can, by way of example, be achieved in that the longitudinal vonveyors for a short time execute a movement which is counter to the movement of the main conveying direction in order to move the weft threads out of the movement area of the forwarding sinker.

It is further preferred that the warp knitting machine includes a weft thread cutting system which is moveable in such a manner so that even when the weft thread insertion system has been halted, the respective last knitted-in weft threads can be cut. That means, that the cutting device of the weft thread insertion system undergoes a movement counter to the movement of the main conveying dierection, which preferably is shaped as transport chains of the longitudinal conveyors. The weft thread cutting system is thereby moved, at times, in the direction of the just knitted-in weft thread in order to obtain a cutting -off of the same.

According to a further aspect of the invention, an arrangement has been created for the production of a knitted fabric involving a warp knitting machine and a separate frame therefrom. On the frame there are arranged a weft thread system with a weft carriage having a servo motor drive and the weft carriage having guides, weft thread off-set rakes with a servo motor drive and longitudinal conveyors having a drive which is independent from the drive of a not shown warp knitting machine associated with the frame, as well as a longitudinal conveyor frame including a drive for the warp knitting machine. According to the inventive device, the drive of the longitudinal conveyors is independent from the machine and is computer controlled in such a manner so that the longitudinal conveyors execute a movement, at least between individual weft threads, that is, at least intermittent and/or continuous and at times with varying speeds. Because of the arbitrary movement of the longitudinal conveyors in the direction of the main fabric conveyance, or also in the direction counter to the main conveyance or with a speed including zero, there is ensured the most flexibility in the production of a knitted fabric having an indefinitely long and freely selectable weft thread repeat.

Further advantages, characteristics and embodiments of the invention are described by way of examples and by having reference to the drawings at hand.

DETAILED DESCRIPTION OF THE DRAWINGS

Figure 1A:
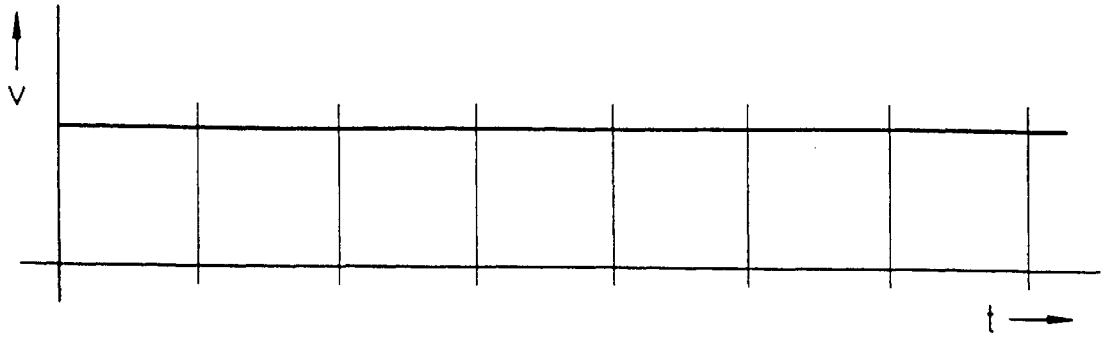
FIG. 1A shows a speed/time diagram for a longitudinal conveyor being driven with a constant speed and regularly inserted weft threads.

In FIG. 1A there is shown a speed/time diagram of a longitudinal conveyor having a constant speed. When the longitudinal conveyor is driven with a constant speed, then a weft thread is laid-into every weft thread hook that is arranged on each longitudinal conveyor (see FIG. 5) and a weft thread is guided per stitch row to the vicinity of the knitting needles according to the illustrated continuous drive of the longitudinal conveyor. This is illustrated in FIG. 1A by the vertical lines, wherein every line corresponds to the end of a weft insertion.

Figure 1B:
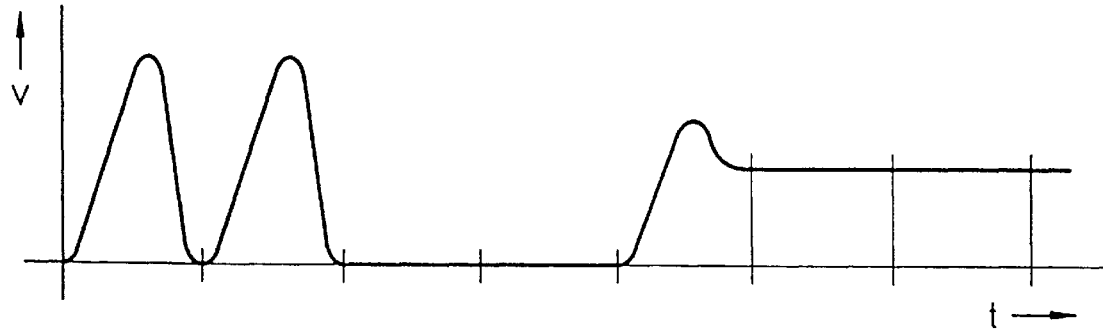
FIG. 1B shows a speed/time diagram for a longitudinal conveyor being driven intermittently and/or continuous and at times with a varying speed and irregularly inserted weft threads

In FIG. 1B there is illustrated a speed/time diagram of a longitudinal conveyor which is driven according to the invention. In the first section (left part of the diagram) there is illustrated an intermittent drive of the longitudinal conveyor having between the positions a speed equal to zero and then a continuously varying speed. This left section in the illustrated diagram corresponds to the insertion of a respective weft thread in two following each other stitch rows, whereby the longitudinal conveyor executes a movement which starts at zero and continues to move toward a maximal value and after crossing this maximal value drops back to zero. That means that the longitudinal conveyors accelerate between each weft insertion, decelerate and finally end up at a speed equal to zero. However, it is also possible to leave the longitudinal conveyors at a constant value during a certain segment and after reaching a maximal speed. This is shown in the right section of the diagram. During an intermittent operation of the drive of the longitudinal conveyors, they are also halted according to the desired weft thread pattern repeat, that is, they are operating with a speed equal to zero. This section corresponds to the middle section of the illustrated diagram. In this section, a weft thread available for a weft insertion in the vincinity of the knitting elements is not inserted so that a weft free stitch formation results at this time.

Figure 1C:
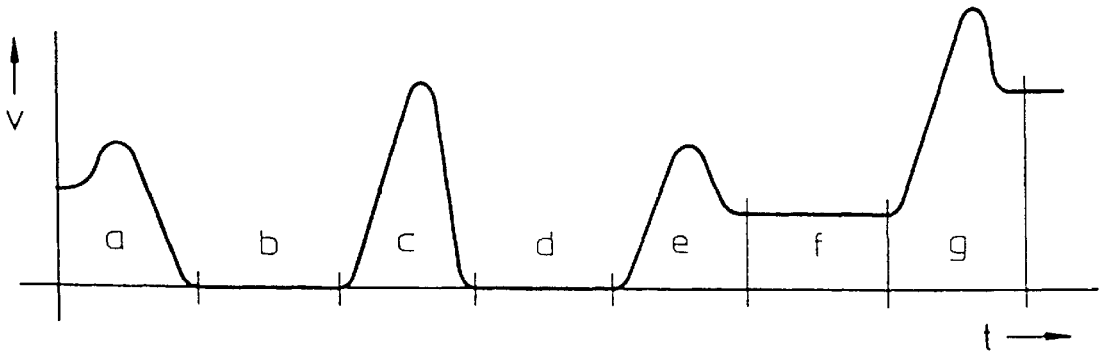
FIG. 1C shows a speed/time diagram for a longitudinal conveyor being driven intermittently and continuously with at times varying and at times constant speed and an irregular weft insertion.

FIG. 1C illustrates a further embodiment of the longitudinal conveyors being driven intermittently and continuously with at least at times varying speed according to a further speed/time diagram. This diagram illustrates that arbitrary speed sequences for the longitudinal conveyors can be created. In the area a of the illustrated diagram, the longitudinal conveyors are driven with a constant speed which is tuned in such a way so that a respective weft thread is knitted-in into every stitch row. After knitting-in the (last) desired weft thread, the longitudinal conveyor is halted in the section b so that at this time no further weft thread will be inserted. In the section c a further weft thread is being inserted, that is, by an acceleration of the longitudinal conveyor from zero to normal speed which is followed by a section of deceleration of the longitudinal conveyor. In section d a short section follows with a deceleration of the longitudinal conveyor to zero after a weft thread has been inserted. Section d again is followed by a short section in which the longitudinal conveyors have a speed of zero whereby the section d is analogous to the illustrated section c. However at the end of the weft insertion it does not revert back to the speed of the longitudinal conveyors to zero but essentially reverts back to half of the speed as is illustrated in section a. In the section e there is a half speed for the longitudinal conveyors having weft thread hooks 21 thereon including two, one after the other and adjacent weft threads, are deposited in the weft thread hooks so that only a respective weft thread is being inserted so that the section e corresponds finally and essentially to the section a. In section f of the illustrated diagram and on the right side, the speed of the longitudinal conveyors is increased to about double of the value of section a so that per normal weft insertion two weft threads per a stitch forming cycle are being inserted. This emphasizes the fact that with the flexible drive system for the longitudinal conveyors according to the invention, not only areas without any weft insertion can be created in any arbitrary intervals but also any arbitrary number of weft threads can be inserted simultaneously into a stitch forming process (of course, keeping in mind the tolerable dimensions of the knitting elements). The wave-like profile illustrated in FIG. 1B in section c as well as in section c of FIG. 1C does not have to be formed symmetrically, of course, but can include a greater acceleration from zero to the maximum value and thereafter can return to zero with a slower deceleration.

Figure 2:
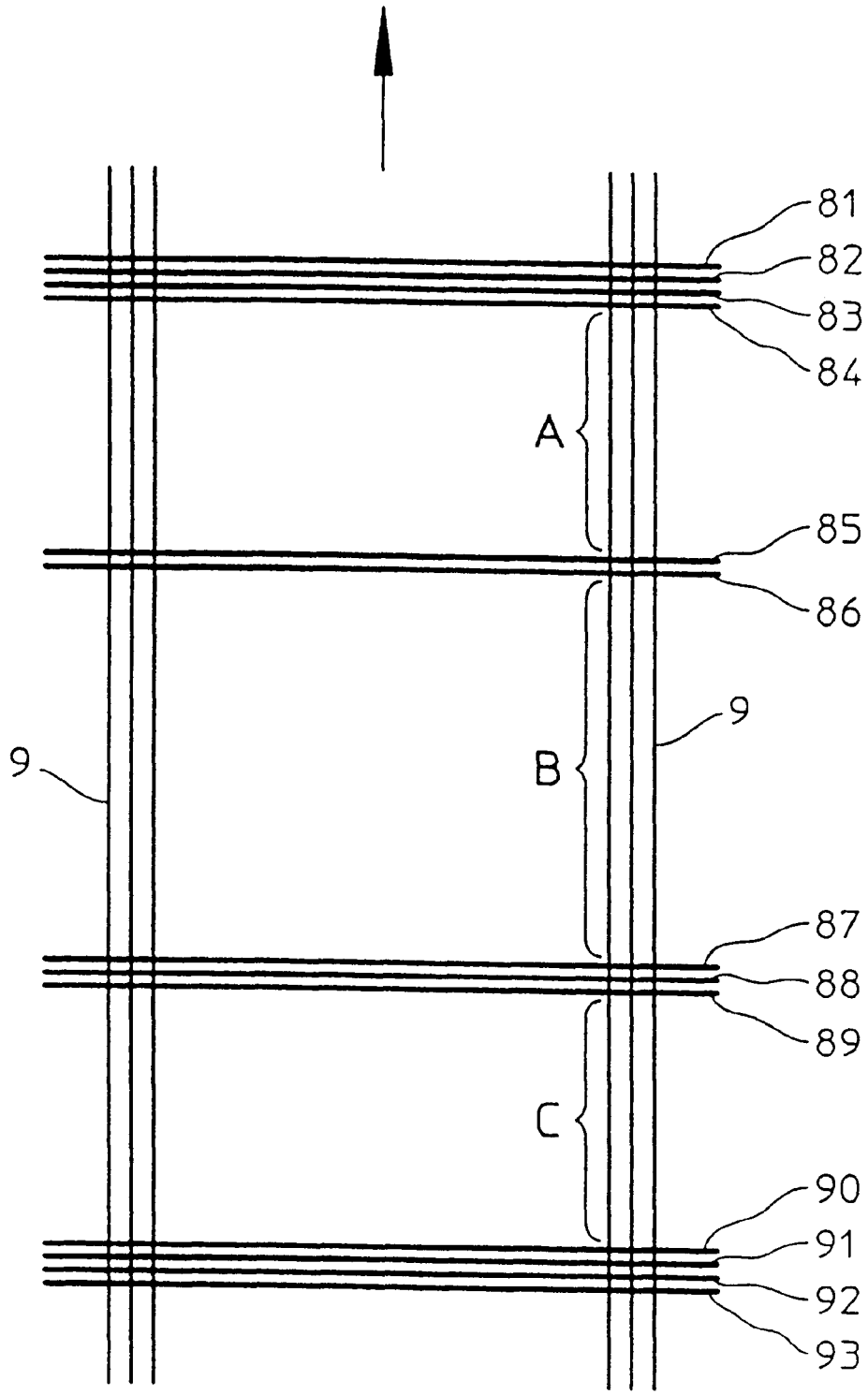
FIG. 2 shows a Geo-Grid knitted fabric having knitted-in weft and stay threads according to a pattern.

FIG. 2 illustrates, by way of an example, a Geo-Grid knitted fabric having weft threads 81 to 93 knitted therein and stay threads 9 arranged therein in the production direction. This Fig. illustrates that weft threads can be arranged in any arbitray intervals and any arbitrary numbers one after the other that can be knitted-in. The intervals A, B, and C between the immediately one after the other knitted-in weft threads 81 to 84 (four) and 85, 86 (two) and 87 to 89 (three) as well as 90 to 93 (four) are different from each other and can arbitrarily be chosen with regard to numbers. Also the number of the one after the other knitted-in weft threads can be varied. After the knitting-in of the four weft threads 81 to 84, merely two weft threads 85 and 86 are knitted-in whereafter three one after the other weft threads 87 to 89 are knitted-in followed again by four one after the other knitted-in weft threads 90 to 93. That means, that the number and the intervals of the knitted-in weft threads can freely and variably be chosen. However, it is also possible as is shown in FIG. 1C in the section f that per stitch not only one or zero weft threads can be knitted-in but also three or four and respectively more per stitch can be knitted-in. All of this can be produced by way of the longitudinal conveyors being driven in an intermittent and/or continuous and at least in time varying speed. From FIG. 2 it can further be seen that the weft thread pattern repeat is not only freely selectable but can also be shaped indefinitely long.

Figure 3:
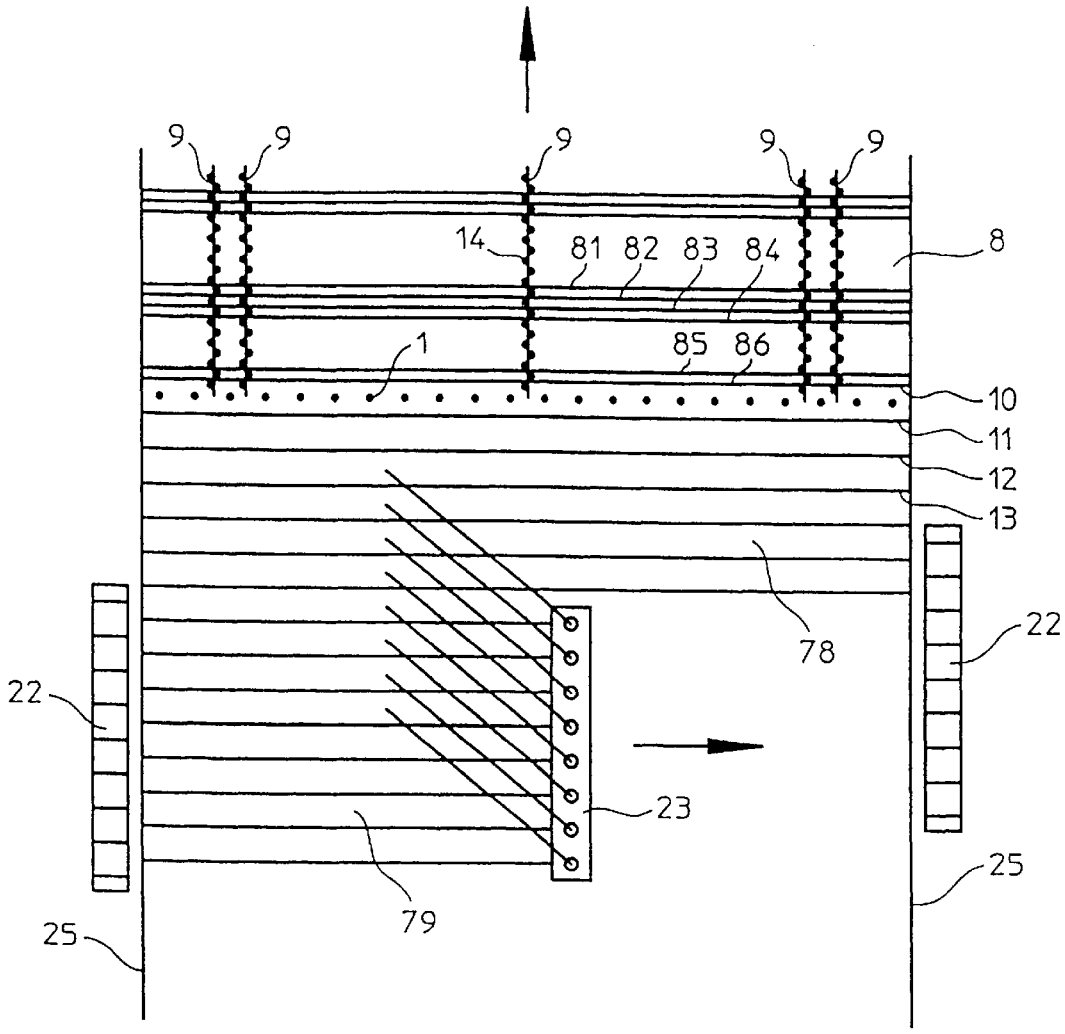
FIG. 3 is a top view of a weft thread array having lontidutinal conveyors arranged on both sides before knitting elements and knitted fabric after the same.

FIG. 3 is a top view of the deposited weft thread array 78 as well as the to be deposited weft thread array 79. The longitudinal conveyors formed as transport chains 25 are illustrated on the left and the right of the weft thread arrays 78 and 79. On each side of the transport chains 25 and exterior of the weft thread arrays 78 and 79 a weft thread off-set rake is being arranged and is driven separately by its own servo motor. The weft threads are inserted into the weft thread array 79 by way of an eyelet bar 23 which is arranged on a weft carriage (not shown) whereby the weft carriage is being moved in the indicated arrow direction from left to right to thereby span the weft thread array 79 and thereby by spanning the same including the weft thread off-set rake for the time being. Because of the execution of a corresponding off-set and insertion movement of the weft thread off-set rake 22, the weft threads to be laid-into the weft thread array 79 that is to be astablished, are inserted into respective weft thread hooks 21 (not shown) which are provided on the transport chains 25. Thereby, the weftt threads at htis point in time form the deposited weft thread array 78. The deposited weft thread array 78 represents a weft thread reserve, that is, a weft thread magazine from which the desired number of weft threads 10, 11, 12, 13 are guided into the area of the knitting elements (illustrated as slide needle 1) in any arbitrary number and any arbitrary intervals corresponding to the intermittent and/or continuous movement with at least varying speed at times driven transport chains. The knitted fabric, which is pulled off behind the knitting element, exhibits stay threads 9 which are surrounded by stitches and weft threads. Corresponding to the basic arrangement according to FIG. 2, the in FIG. 3 illustrated knitted fabric 8, initially four weft threads 81, 82, 83, 84 were knitted-in and is then followed by a weft free section. Immediately behind the knitting elements, the weft threads 85, 86 are already knitted-in. The weft thread 10 thereby correponds to the knitted-in weft thread 86. The weft threads 10, 11, 12, 13 represent the weft threads which immediately were knitted-in (weft thread 10), respectively, which are guided to the knitting area by the controlled speed of the transport chains 25 in one after the other arranged sequence with selected intervals or without intervals.

In one area between the transport chains 25 the movement of the weft carriage 48 (not illustrated, see FIG. 9) can be decoupled from the movement of the transport chain. In the area of the weft thread off-set rakes 22 the movement, however, is synchroniously shaped to the repeat of the teeth of the weft thread off-set rake so that even when the movement of the transport 25 is intermittent and/or continuous or with a varying speed, the weft threads of the weft thread array 79 can reliably be laid into the respective weft thread rakes 22. At the same time the movement of the weft thread off-set rakes 22 can synchroniously be coupled to the movement of the transport chains 25 so that the weft threads laid into the weft thread rakes of the weft thread array 79 can reliably be laid into the weft thread hooks 21 (not shown).

Figure 4:
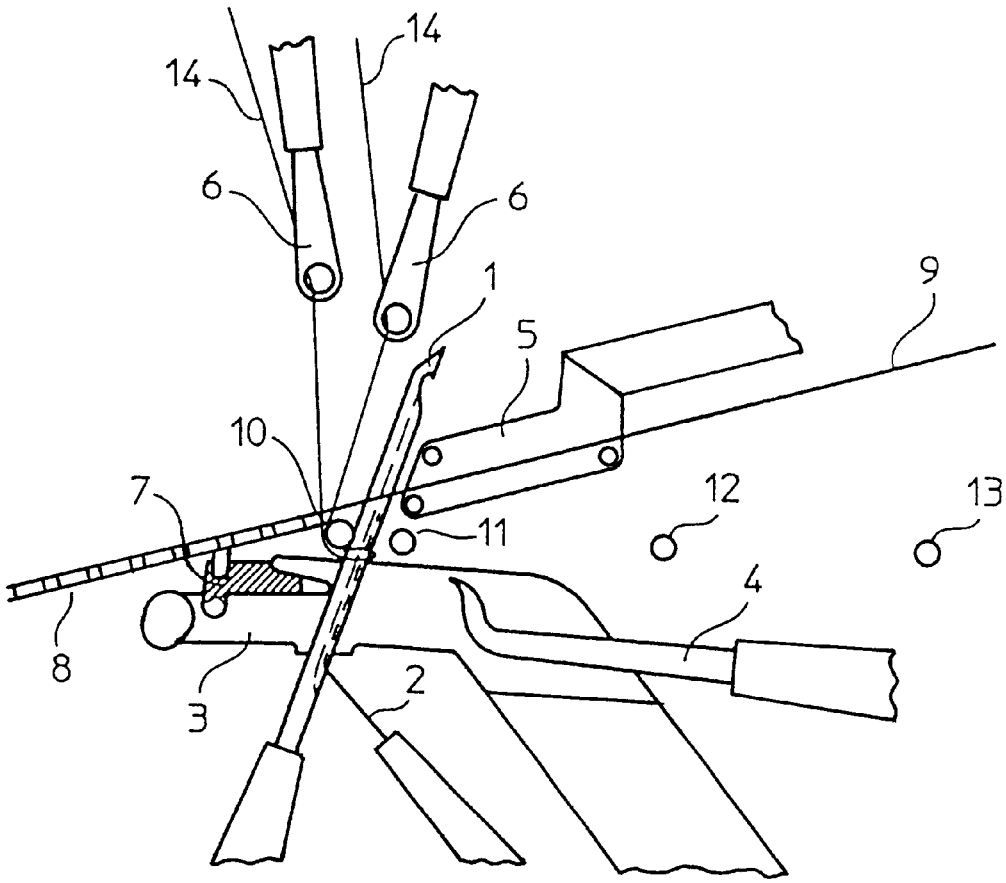
FIG. 4 shows a basic arrangament of the fontour with an indicated sequence of the insertion of weft threads.

FIG. 4 shows a fontour of a warp knitting machine in side view according to one development example. In this basic illustration of the fontour of a warp knitting machine in a side view only the requisite knitting elements have been illustrated that are necessary for the knitting process. These are the slide needle 1, the slide 2, the enclosing and knock-off sinker 4, and the guide needle 6 which are all held in their not illustrated respective fittings which fittings are represented in FIG. 4 by the black shaded areas. The respective fitting is fastened on a bar in a known manner and for the movement of the respective knitting elements. The knitting threads, that is, the warp threads 14 are guided to the slide needle 1 and laid around the slide needle 1 whereby a stitch (not shown) is formed at the slide needle 1. Moreover, the stay threads 9 which extend in the direction of the fabric pull-off direction (in FIG. 4 only one stay thread has been shown) and the weft threads 10, 11, 12, 13 are guided to the knitted fabric.

The weft threads are, in a known manner, brought to a suitable position so that they can be knitted-in by stay thread forwarding sinker 4 which is illustrated by the weft thread 10. The stay thread 9 is guided by a stay thread sinker 5 with respect to its height position. The enclosing and knock-off sinker 3 is provided with an additional knock-off fitting 7 which extends laterally over the individual enclosing and knock-off sinkers 3. This additional enclosing and knock-off fitting 7 is set up on the stitch knock-off edge of the enclosing knock-off sinker and juts with a projection, for a sure arresting, under a nose and into a throat (each not shown) of the enclosing knock-off sinker. The additional knock-off fitting is fastened by way of wire which penetrates through the individual enclosing knock-off sinkers. Because of the set up of the additional knock-off fitting on the enclosing knock-off sinker 3, only a known warp knitting machine having enclosing knock-off sinkers (see, for example DE-PS 1760 140) will be modified in such a manner so that, because of the effect the additional knock-off fitting has, a stationary fabric pull-off edge is being formed.

Because of the set up of the additional knock-off fitting 7 on the enclosing knock-off sinker 3 and the fastening of the enclosing knock-off sinkers, it is easily possible to modify an existing warp knitting machine for the production of tricot and technical knittings such as geo-knitted fabrics, for example. This is described in detail in DE 42 28 048 C2 of the applicant.

Figure 5:
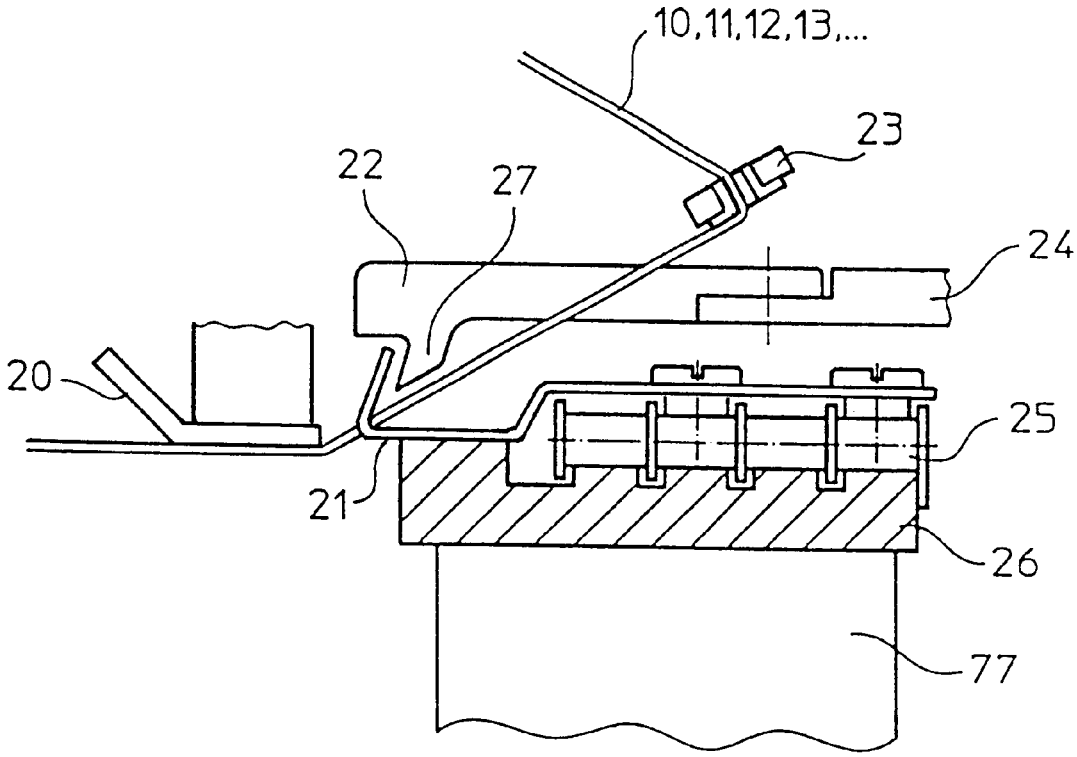
FIG. 5 shows a basic arrangement of a longitudinal conveyor rail having been screwed onto a chain guiding frame.

FIG. 5 shows a basic arrangement of a transport chain 26 being guided on a transport rail 26. This transport rail 26 is tightly screwed onto a chain guiding frame. Weft thread hooks are fastened to the transport chain. During the laying-in process of the weft threads into the teeth 27 of the weft thread off-set rake 22, a weft thread downward presser rail 20 presses the in a higher plane guided weft threads 10, 11, 12, 13 between the weft thread hooks 21 and the teeth 27 of the weft thread off-set rakes which are located behind the weft thread hooks 21. As soon as the weft threads 10, 11, 12, 13 are laid-in behind the teeth of the weft thread off-set rake 22, the weft thread rake executes a movement which is counter to the direction of the exiting fabric 8. Weft threads are guided in groups by way of the eyelet bar 23 in the weft carriage 48 (not shown). The individual teeth 27 of the weft thread rake 22 are fastened to a holding plate 24.

The movements of the weft thread off-set rake 22 and the longitudinal conveyors 25 are correlated with each other in such a manner so that the teeth 27 of the weft thread off-set rake 22 and the weft thread hooks 21 are aligned with the corresponding hook rows of the longitudinal conveyors 25 when the weft carriage 48 transits the same until the individual weft threads 10, 11, 12, 13 are guided between the individual weft thread hooks 21 and the teeth 27 and will align with the thereafter following line of weft thread hooks 21 after a relative movement of the longitudinal conveyor and after the weft thread carriage has transited the same in the direction of the opposite margin of the weft thread array 79 (see FIG. 3).

In a simplified manner illustrated in FIG. 5, after a successful laying-in of the weft threads 10, 11, 12, 13 into the weft thread hooks 21, the clamping pushers which are necessary for the clamping of the weft threads have been omitted. The function and construction of these clamping pushers are described in detail in DE 37 29 344 C2 of the applicant. Therefore, a more detailed description is not included here.

Figure 6:
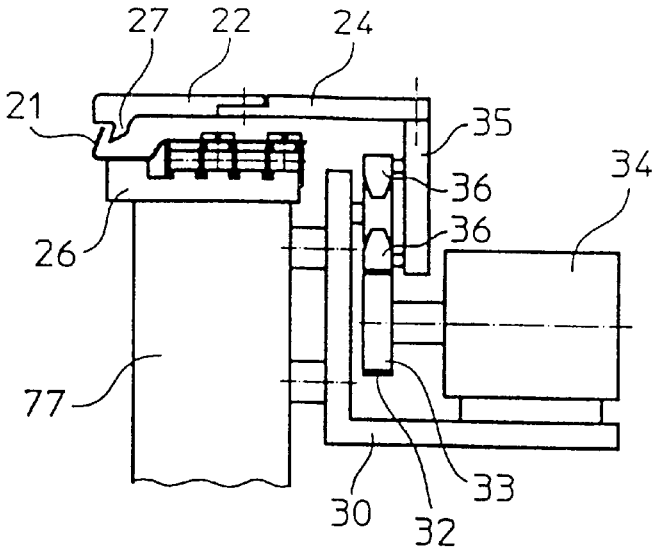
FIG. 6 shows the drive of the weft thread off-set rake with a view toward the main conveyor direction of the longitudinal conveyors.

FIG. 6 illustrates a drive for the weft thread off-set rake 22 in side view. On each respective chain guide frame 77, a mounting plate 30 is fastened for the entire off-set rake unit. On this mounting plate 30 there is arranged the entire off-set rake drive with a computer controlled servo motor 34, a driving cleated belt pulley 33, a corresponding deviation cleated belt pulley 31 (see FIG. 7), a cleated belt 32, an off-set rake console 35, linear guides 36, a holding plate 24 for the teeth 27 of the off-set rake 22. By way of such a servo motor drive for the weft thread off-set rake, it is possible to optimally correlate the movement of the longitudinal conveyor 25 with that of the movement of the weft thread rake 22 even under the condition when the longitudinal conveyor is driven intermittently and/or continuously and at least at times with a varying speed.

Figure 7:
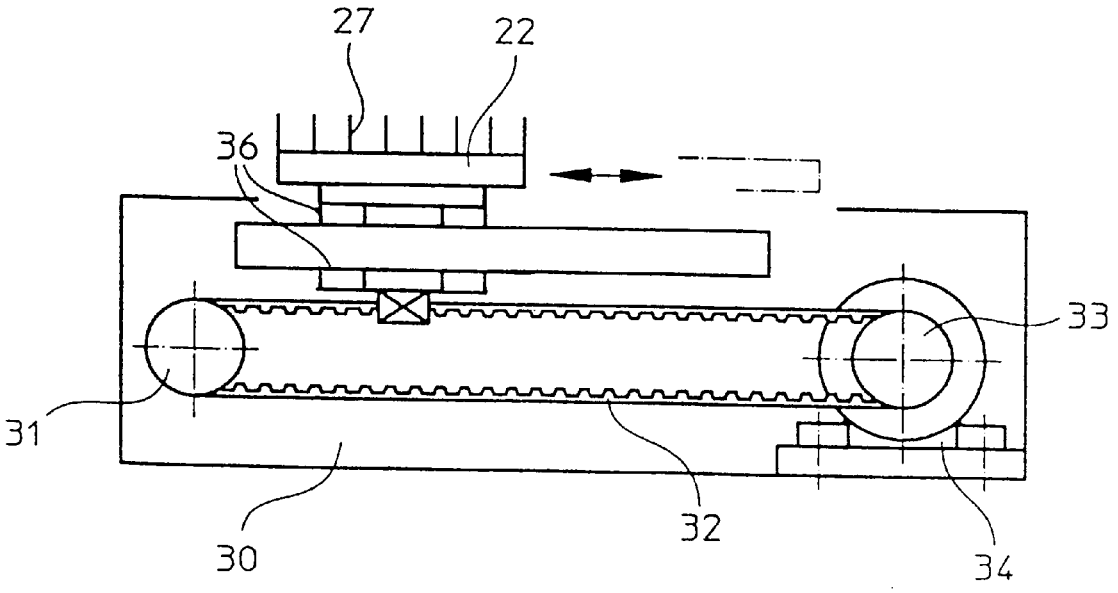
FIG. 7 shows the drive of the weft thread rake according to FIG. 6 with a view vertical to the main conveyor direction of the longitudinal conveyors.

FIG. 7 is a side view of the drive for the weft thread off-set rake according to FIG. 6. The weft thread off-set rake which is movable in the direction of the double arrow and is movable in linear guides 36 so that it executes a movement relative to the movement of the longitudinal conveyors 25 (not shown). The movement of the weft thread off-set rake is being controlled by the servo motor 34 which by way of the cleated belt 32 transfers its movement to the off-set rake by way of a sled (not shown) which is arranged on the linear guide 36. The servo motor 34 is mounted on a mounting plate 30 on which the deviation cleated belt pulley is also supported.

Figure 8:
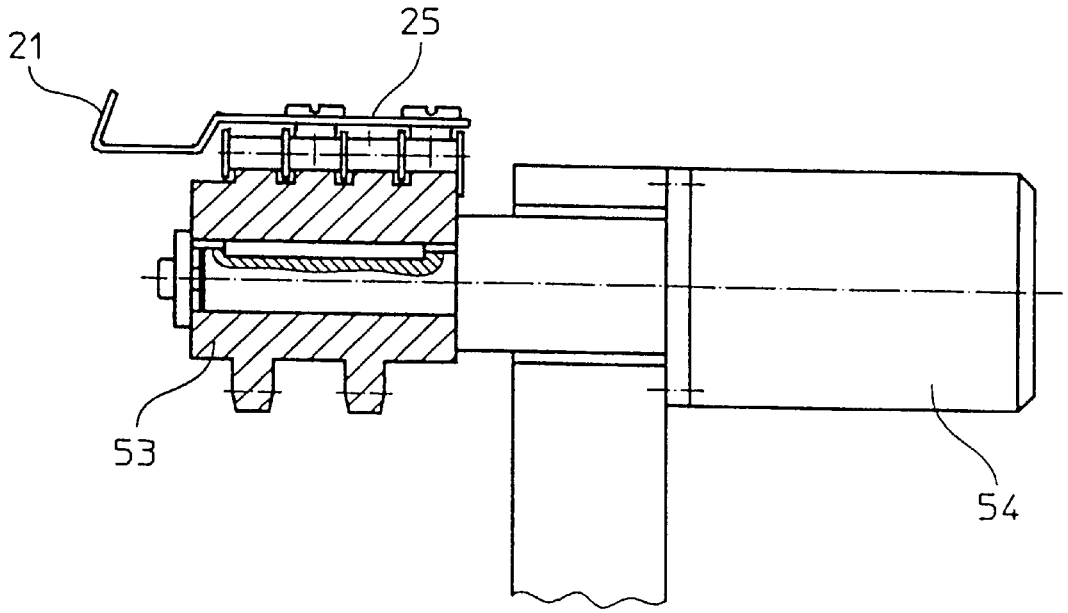
FIG. 8 shows a basic arrangement of the drive for a longitudinal conveyor by way of a servo motor being fastened to the chain guiding frame.

FIG. 8 shows the drive for a transport chain 25 by way of a computer controlled servo motor 54. The servo motor 54 is fastened to the weft chain guiding frame 77. The movement of the servo motor 54 is being transmitted to the transport chain 25 by way of the driving chain pulley 53. Weft thread hooks 21 are fastened to the transport chain 25 (see FIG. 5). Because of the use of a servo motor 54 for each transport chain, whereby the servo motors are preferably synchronized with each other, a transport drive shaft for the transport chains can be eliminated which enhances the accessibility to the machine for repair and maintenance purposes.

Figure 9:
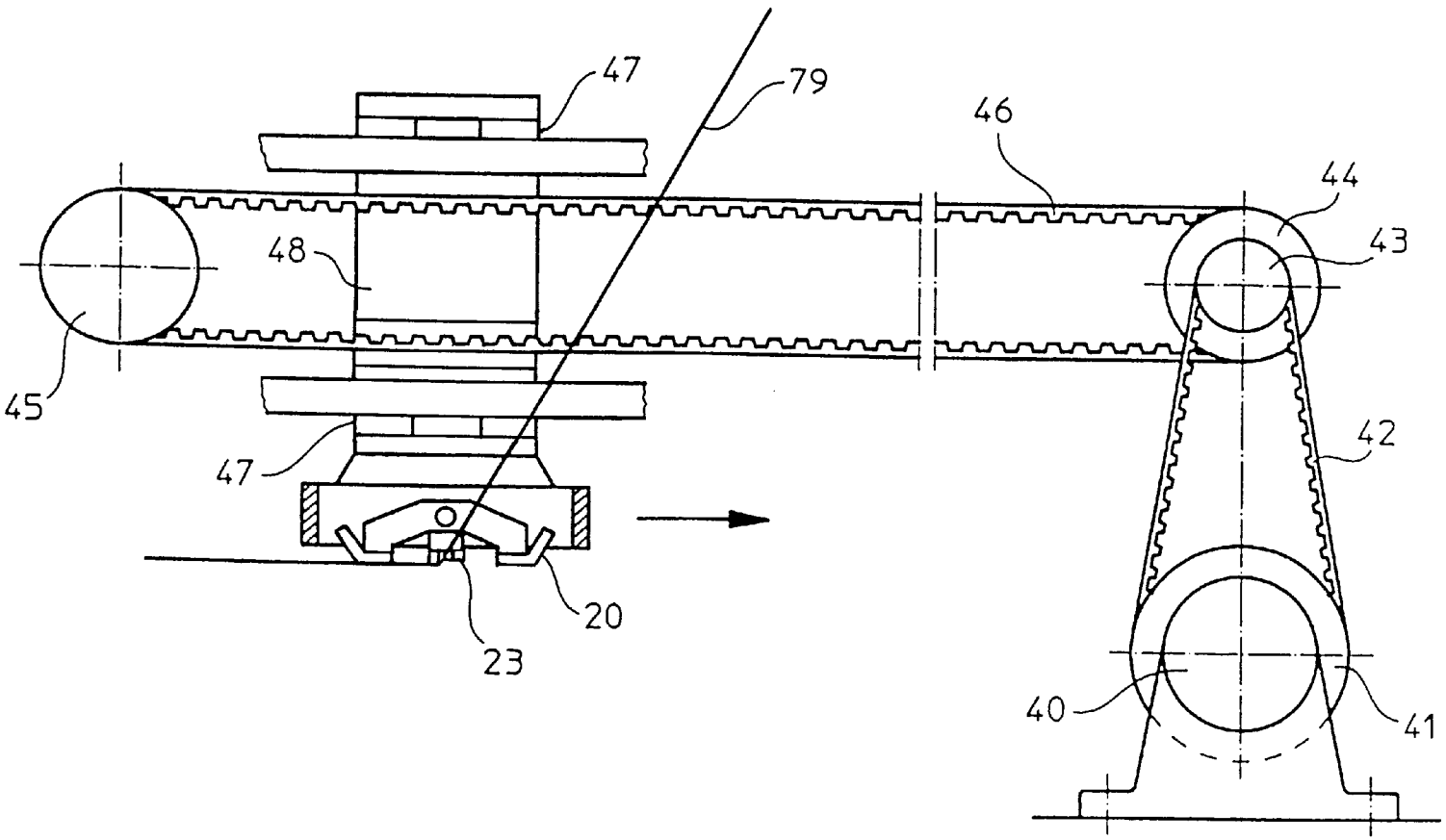
FIG. 9 shows a basic arrangement of the drive for the weft carriage by way of a servo motor.

FIG. 9 shows, in a basic illustration, the drive for the weft carriage 48 including a computer controlled servo motor 40. The movement of the computer controlled servo motor 40 is initially transferred to a driven cleated belt pulley from which by way of a cleated belt 42 the movement is further transferred to a further deviation cleated belt pulley 43 which is connected to a further driven cleated belt pulley 44. This driven cleated belt pulley is further connected to a further deviation pulley by way of a further cleated belt 46 the cleated belt 46 transfers its movement to a weft carriage 47. Through the movement of the weft carriage, the weft threads are laid-in into the to be laid-in weft thread array 79. The weft threads are thereby guided to the weft carriage and are deviated in the eyelet bar 23 in the weft carriage 48. Also the weft thread donward presser rail 20 is arranged on the weft carriage which is formed as a wipping frame. Because of the wipping frame, the wefts are laid into the off-set rake by pressing donwardly. Because of the relative movement of the weft thread off-set rake, the weft threads slide along the teeth 27 and thereby end up in the weft thread hooks 21 which are fastened on the transport chains 25.

Figure 10:
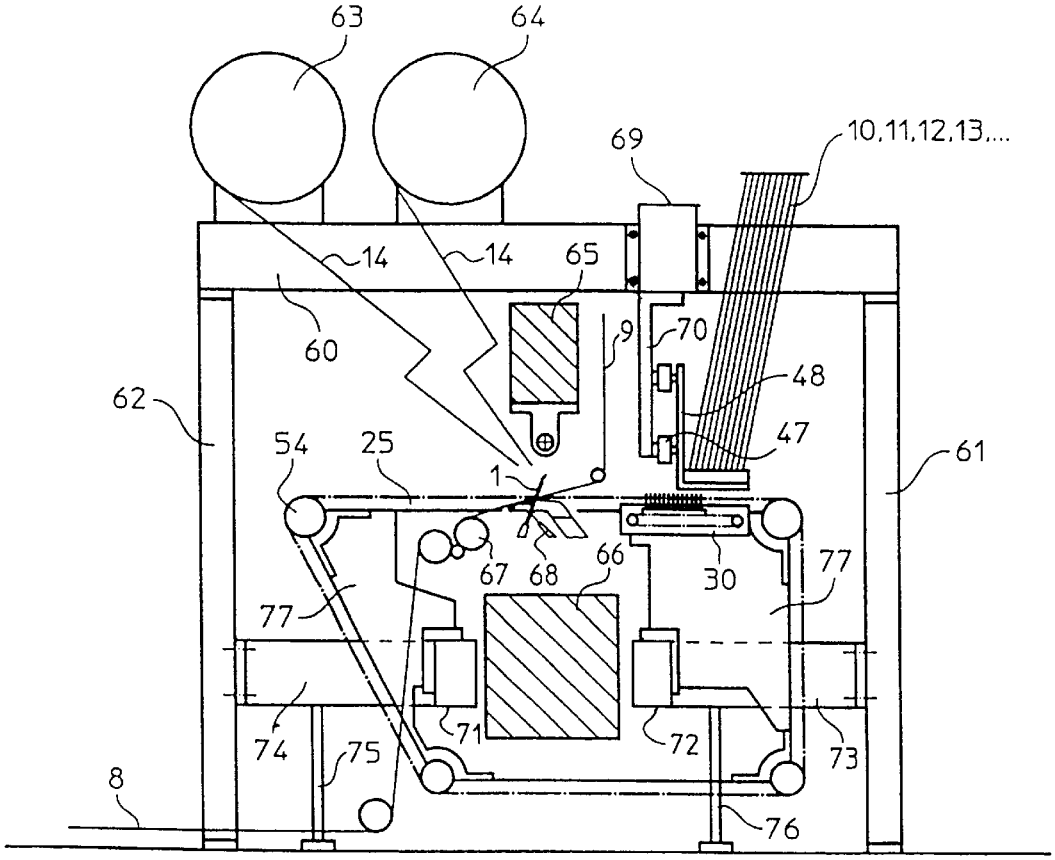
FIG. 10 shows a basic arrangement of an installation of a warp knitting machine in combination with a frame according to a further development of the invention.

FIG. 10 illustrates an arrangement according to a third aspect of the invention. The actual warp knitting machine is illustrated by way of dashed lines (machine main support 65 and machine base 86) and is shown in a simplified way. The entire weft insertion system and all of the drive systems are fastened on a separate frame 60, 61, 62. Because of the separation of the actual warp knitting machine and the weft thread insertion system, the vibrations caused by respective parts is not being transferred to other parts. Both of the chain guiding frames 77 located on the left and right side of the working width are sideways adjustably fastened on the weft thread guiding frame supports 71 and 72. A transport chain 25 is illustrated in dot-dash lines which circulates around the machine base. However, it is entirely possible that the transport chain is returned at least on a side which is above the machine base 66.

The weft guiding frames supports 71 and 72 are fastened to holding parts on one column 61 and another column 62 of the frame. Both columns are connected to each other by way of a cross-carrier. On one cross-carrier 60, a weft carriage beam 69 is fastened over the whole width. On weft carriage beam 69, holders for the linear guides have been provided. The weft carriage 48 is driven by a servo motor 40. On at least one chain guiding frame 77, a servo motor 64 is rigidly mounted. In case that each transport chain 26 is not driven by a servo motor, the servo motor will operate on a drive shaft by which the transport chains can synchroniously be driven. The warp beams 63 and 64 are advantageously supported on the frame 60, 61, 62. There is a further illustration of a mounting plate 30 on which the weft thread off-set unit is mounted. The weft threads 10, 11, 12, 13 are laid into the off-set rake unit whereby the weft thread rakes are being off-set by way of a separate servo drive relative to the movement of the transport chains 25, so that the weft threads can be laid- into the weft thread hooks (not shown). Also illustrated is a stay thread 9 which has been guided to the knitting elements (such as a slide needle 1) by way of a deviation roller (not shown). In another basic illustration, the knitting bars 68 are shown. By way of the fabric pull-off rollers 67, the thus produced knitted fabric 8 is deviated and pulled-off. Furthermore, holding parts 73 and 74 for the column are provided in the front and in the back by which the column is supported by the respective supports 76 and 75.

Figure 11:
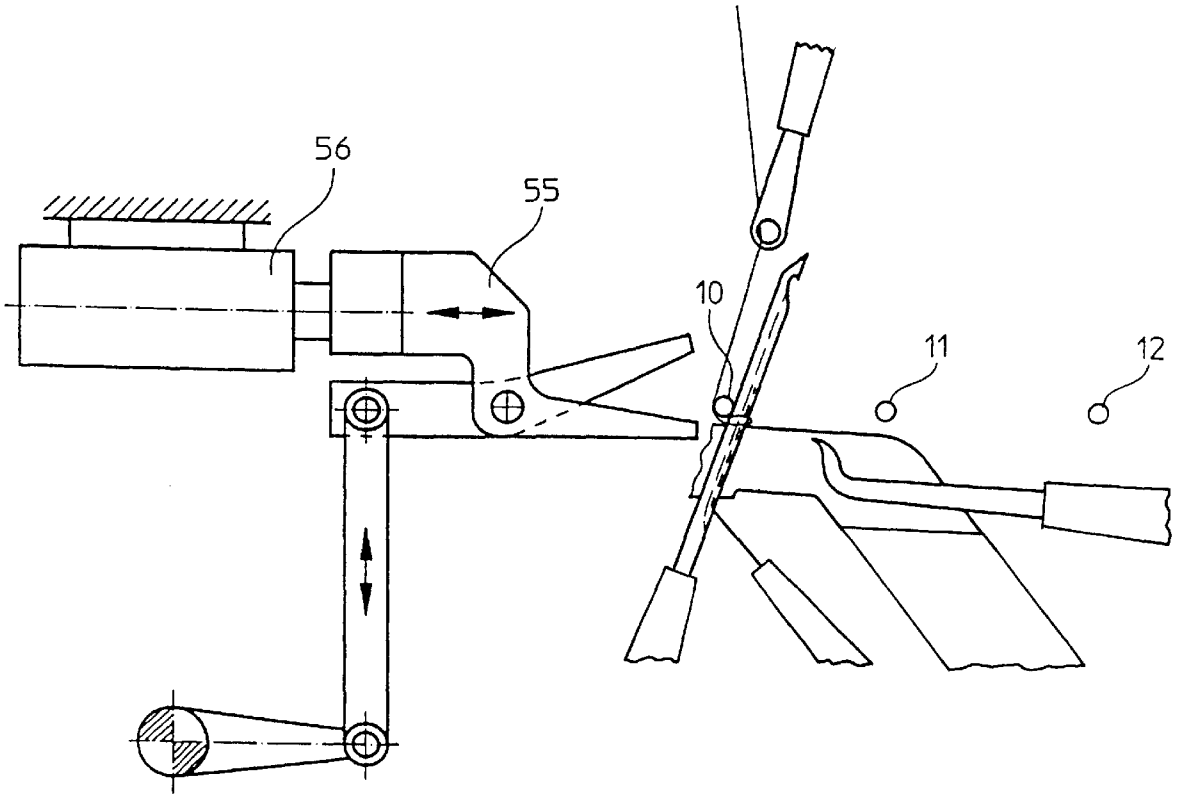
FIG. 11 shows the fontour of a warp knitting machine in side view including a weft thread cutting device.

FIG. 11 illustrates the fontour of a warp knitting machine in side view with the associated weft thread cutting device. When the weft insertion system has been halted, the respective last bound-in weft thread, indicated as 10, is being cut by way of a weft thread cutting system 55 which is being moved in the direction of the double arrow by way of a pneumatic cylinder 56.

The weft thread cutting system 55, at least at times, is being moved counter to the direction of the weft insertion so that the already bound-in weft thread 10 can reliably be cut. Thereafter, the weft thread cutting system 55 is again being moved back in the direction of the transport direction of the weft threads.

According to the inventive method for the production of a knitted fabric it is possible to obtain the highest flexibility in the production of a warp knitted fabric with regard to a freely selectable and indefinite long weft pattern repeat.

What we claim is:

| List of reference characters | |
|---|---|
| 1 | Slide needle |
| 2 | slide |
| 3 | enclosing and knock-off sinker |
| 4 | weft thread forwarding sinker |
| 5 | stay thread sinker |
| 8 | guide needle with guide holes |
| 7 | additional knock-off fitting |
| 8 | knitted material |
| 9 | stay threads |
| 10 | weft thread brought behind needle |
| 11, 12, 13 | weft threads |
| 14 | warp thread |
| 20 | weft thread downward presser rail |
| 21 | weft thread hooks |
| 22 | weft thread off-set rake |
| 23 | eyelet bar in the weft carriage |
| 24 | holding plate for rack teeth |
| 25 | transport chain |
| 26 | rail for transport chain |
| 27 | teeth of the off-set rake |
| 30 | off-set rake unit mounting plate |
| 31 | deviation pulley for the cleated belt |
| 32 | cleated belt |
| 33 | drive pulley for cleated belt |
| 34 | servo motor drive for off-set rake |
| 35 | off-set rake support |
| 36 | linear guides |
| 40 | servo motor drive for weft carriage |
| 41 | drive pulley for cleated belt |
| 42 | cleated belt |
| 43 | deviation pulley for the cleated belt |
| 44 | drive pulley for cleated belt |
| 45 | deviation pulley for cleated belt |
| 46 | cleated belt |
| 47 | linear guides |
| 48 | weft carriage |
| 53 | drive chain wheel |
| 54 | servo motor for transport chain |
| 55 | weft thread cutting system |
| 56 | pneumatic cylinder |
| 60 | separate beam frame cross carrier |
| 61 | column in the back |
| 62 | column in the front |
| 63, 64 | warp beam |
| 65 | machine main carrier |
| 66 | machine main base |
| 67 | fabric pull-off rollers |
| 68 | knitting bars |
| 69 | weft carriage carrier on separate beam frame |
| 70 | holder for linear longitudinal guides |
| 71 | weft guides frame carriers in front |
| 72 | weft guides frame carriers in back |
| 73 | holding elements for column in the back |
| 74 | holding elements for column in the front |
| 75 | supports up front |
| 76 | supports in back |
| 77 | chain guide frame |

-continued

| List of reference characters | |
|---|---|
| 78 | deviated weft thread array |
| 79 | weft thread array to be inserted |
| 81 to 93 | weft threads |

1. A method for production of a warp knitted fabric having an indefinitely long and a freely selectable pattern repeat, the method including the steps of inserting weft threads by way of a weft insertion system and guiding said weft threads into an area of knitting needles by way of moving longitudinal conveyors and driving said longitudinal conveyors independently of a machine drive of a warp knitting machine making said warp knitted fabric in at least one of an intermittent or continuous way with at least an occasional varying speed such that the weft threads are guided to the area of the knitting needles according to a pattern at arbitrary times and one after another in arbitrary and desired numbers.

2. A method according to claim 1, wherein said longitudinal conveyors located at least on both sides of the warp knitted fabric are driven independently of each other.

3. A method according to claims 1 or 2, including inserting the weft threads substantially parallel to each other.

4. A method according to claims 1 or 2, including inserting the weft threads substantially diagonal so that the weft threads are arranged at an angle different from 90° with regard to the movement of said warp knitted fabric.

5. A method according to claim 1, including driving said weft insertion system and weft thread off-set rake independently from the machine drive.

6. A method according to claim 5, in which, at least during an insertion phase of the weft insertion system and the weft thread off-set rake, a movement is executed having movement phases that are correlated with each other which are in at least one of an intermittent or continuous manner and have at least an occasionally varying speed.

7. A method according to claim 1, including driving said longitudinal conveyors in such a manner so that the weft threads deposited thereon execute a forward sinker-like movement to thereby end up behind the knitting needles.

8. A method according to claim 1, wherein the weft thread is bound in and then cut, and wherein the longitudinal conveyors are slightly moved against the conveying direction when a weft thread has been bound-in but not yet cut.

9. A method according to claim 1, wherein the weft insertion system is occasionally halted, and wherein the longitudinal conveyors are driven in such a manner that when the weft insertion system has been halted, the next weft thread to be delivered to the stitches is not located in the range of the forwarding sinker which executes its movement during each stitch forming cycle.

10. A warp knitting machine for production of warp knitted fabric (8) including a machine drive, a weft insertion system having a weft carriage (48), and longitudinal conveyors (25) having a drive (54) and being located at least on both sides of a width of the knitted fabric, said longitudinal conveyors (25) having weft thread holders (21) for holding weft threads (10, 11, 12, 13) having been laid therein by said weft thread insertion system, and by said longitudinal conveyors the weft threads (10, 11, 12, 13) are capable of being inserted into the range of the knitting needles (1, 2, 3, 4), characterized in that said drive (54) of the longitudinal conveyors (25) is independent of said machine drive and imparts to said longitudinal conveyors (25), at least between the individual weft threads (81, 82, 83, 84), a computer controlled movement being at least one of an intermittent or continuous movement and with their speeds being at least occasionally variable.

11. A warp knitting machine according to claim 10, characterized in that the longitudinal conveyors (25) are connected to a common drive shaft which is driven by a servo motor.

12. A warp knitting machine according to claim 10, characterized in that each longitudinal conveyor is driven by a separate servo motor (54).

13. A warp knitting machine according to claim 10, characterized in that the drive of the weft carriage (48) includes a servo motor (40) which is driven independently of the machine drive.

14. A warp knitting machine according to claim 10, characterized in that weft thread off-set rakes (22) are provided and, by a servo motor (34), are capable of being controlled and driven independently of the machine drive.

15. A warp knitting machine according to claim 14 characterized in that said weft thread off-set rakes (22) and said weft carriage (48) are capable of being driven such that, at least during a part of their movement path, they execute a movement which is at least one of intermittent or continuous and at least occasionally varies their speed.

16. A warp knitting machine according to claim 15 including means for correlating the movement of the weft thread off-set rakes (22) which is at least one of intermittent or continuous and having at least an occasional varying speed and the movement of the weft carriage (48), during the laying-in and off-set phase, with the movement of the longitudinal conveyors (25).

17. A warp knitting machine according to claim 14 including means for correlating the movement of the weft carriage (48) and the movement of the off-set rakes (22) by their servo motors (40, 34) so that a weft thread insertion, after any arbitrary weft, is capable of being interrupted for any arbitrary length of time.

18. A warp knitting machine according to claim 10, including means for driving said longitudinal conveyors (25) so that the weft threads (10, 11, 12, 13) supplied to the range of the knitting needles (1, 2, 3, 6) execute a forward sinker-like movement such that they are safely moved behind the knitting needles.

19. A warp knitting machine according to claim 10 including means for cutting the weft thread, and means for driving the longitudinal conveyors (25) so that they will move slightly counter to the conveying direction when the respective last weft thread (10) has been knitted-into the stitches but before it is cut.

20. A warp knitting machine according to claim 10, including means for halting the weft insertion system, and means for driving the longitudinal conveyors (26) so that when the weft insertion has been halted, the next weft thread (11) to be guided to the stitches remains outside of the area where a weft thread forwarding sinker (4) is located and carrying out its movement during each stitch forming cycle.

21. A warp knitting machine according to claim 10 including means for moving a weft thread cutting system (55) in such a manner so that even though said weft insertion system has been halted, the respective last knitted in weft thread will be cut.

22. An arrangement for production of a knitted fabric including a warp knitting machine (65, 66) and a separate frame (60, 61, 62), wherein a weft thread insertion system having a weft carriage (48) driven by a servo motor (40), and having weft carriage guides (47), off-set rakes (22) having a servo motor drive (34) and longitudinal conveyors (25) with a drive (54) and a longitudinal conveyor frame (77) of said warp knitting machine (65,66) having a machine drive are arranged on said frame (61, 61, 62), and wherein the drive (54) of the longitudinal conveyors (25) is independent of the machine drive and is computer controlled to thereby induce at least one of an intermittent or continuous movement and at least an occasional varying speed to said longitudinal conveyors (25) at least between the individual weft threads (10, 11).

23. A method according to claim 1, wherein the warp knitting machine operates only in an intermittent manner.

24. A method according to claim 1, wherein the warp knitting machine operates only in a continuous manner.

25. A method according to claim 1, wherein the warp knitting machine operates only in an alternating intermittent and continuous manner.

* * * * *